United States Patent [19]

Shepherd et al.

[11] Patent Number: 4,972,782

[45] Date of Patent: Nov. 27, 1990

[54] PALLET

[75] Inventors: Royston L. Shepherd, Hildenborough; Garry M. Shepherd, Ticehurst, both of Great Britain

[73] Assignee: Pallet Handling Ltd., Hildenborough, Great Britain

[21] Appl. No.: 275,379

[22] Filed: Nov. 23, 1988

[30] Foreign Application Priority Data

Nov. 27, 1987 [GB] United Kingdom ..... 8727765

[51] Int. Cl.[5] ..... B65D 19/26

[52] U.S. Cl. ..... 108/52.1; 108/51.1

[58] Field of Search ..... 108/52.1, 51.1

[56] References Cited

U.S. PATENT DOCUMENTS 3,380,404 4/1968 Shell ..... 108/52.1
4,059,057 11/1977 Carnwath ..... 108/52.1
4,145,975 3/1979 Colbert ..... 108/52.1
4,267,780 5/1981 Candella ..... 108/52.1
4,571,141 2/1986 Gieson ..... 108/52.1

FOREIGN PATENT DOCUMENTS 763420 12/1956 United Kingdom ..... 108/52

*Primary Examiner*—Peter A. Aschenbrenner
*Attorney, Agent, or Firm*—Ladas & Parry

[57] ABSTRACT

A pallet having a top surface on which a load or deck may be mounted, first channels into which the forks of a forklift truck may be inserted from all sides to lift the pallet, and second open topped channels into which the forks of a forklift truck may be inserted from all sides to lift the load or deck surface alone without the pallet. The first channels are in the form of closed sections forming part of the pallet itself.

8 Claims, 6 Drawing Sheets

PALLET

BACKGROUND OF THE INVENTION

The present invention relates to a pallet. Conventionally pallets are used to mount a load and enable a forklift truck to engage under the load to lift the load. The forklift truck may be motorized or may be a hand operated forklift truck ie a pallet truck. The pallets which are often of wood comprise a top deck and a lower deck spaced from one another by blocks of wood, the top and lower decks being spaced so as to allow the forks of a forklift truck to enter between the top and lower decks so as to lift the top deck and hence a load mounted on the top deck. Pallets are sometimes made of other materials such as steel.

Substantial numbers of pallets are required and although they are intended to be returnable, in practice a manufacturer of goods has to provide many pallets and the final retailer of the goods tends to be left with large numbers of pallets which have to be returned to the manufacturer if they can be identified. In practice, retail outlets often collect large numbers of pallets which take up a considerable amount of room and are generally inconvenient.

SUMMARY OF THE INVENTION

The present invention provides a pallet having a top surface on which a load or deck may be mounted, first channels into which the forks of a forklift truck may be inserted to lift the pallet, and second open topped channels into which the forks of a forklift truck may be inserted to lift the load or deck surface alone without the pallet characterized in that the first channels are in the form of closed sections forming part of the pallet itself.

Thus, in use this pallet may be used in a conventional manner or alternatively, a thin disposable or returnable deck may be mounted on top of the pallet. The load, at any stage during transportion, may be lifted from the pallet separately thereby leaving the pallet behind.

The first channels may be formed by one or more moveable members (usually one member) engaged in the second open topped channels whereby at rest it is situated in the bottom of the open topped channels and when engaged by the forks of a forklift truck and raised, moves up, but remains within, the open topped channels. The moveable member may have a top surface which, when moved up in the open topped channels, is generally coplanar with (in practice, slightly above) the top surface of the pallet.

The moveable member may be restrained from leaving the open topped channels by virtue of their cross sectional shapes, by means of spigots engaging grooves, or other means.

In an alternative arrangement, an upper wall of the closed sections of each said first channels is formed by a fixed wall member forming a fixed part of the pallet itself.

The pallet may be manufactured of steel, wood, plastic, including fibre reinforced resin, such as fibreglass or other suitable material.

As is conventional, there may be provided two sets of channels on each side to engage the two forks of a forklift truck.

BRIEF DESCRIPTION OF THE DRAWINGS

Pallets embodying preferred aspects of the invention will now be described by way of example only and with reference to accompanying drawings in which.

DETAILED DESCRIPTION OF PREFERRED EMBODIMENTS

Figure 1:
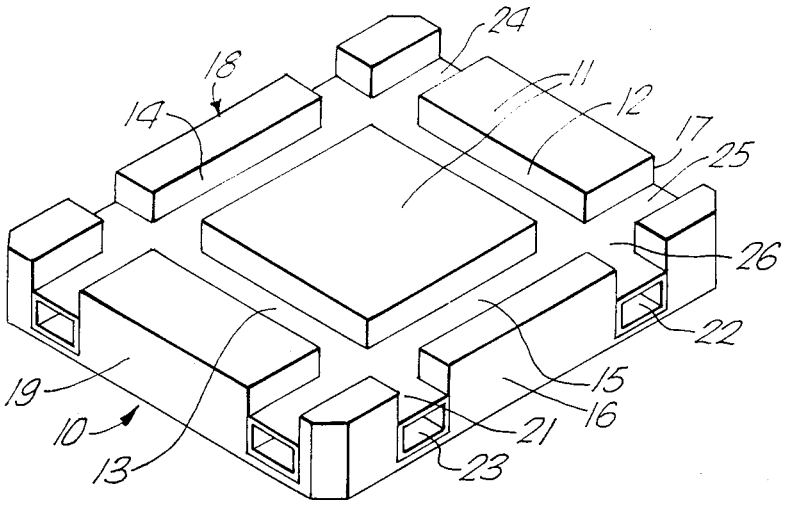
FIG. 1 is a top perspective view of a pallet according to aspect of the invention.
Figure 2:
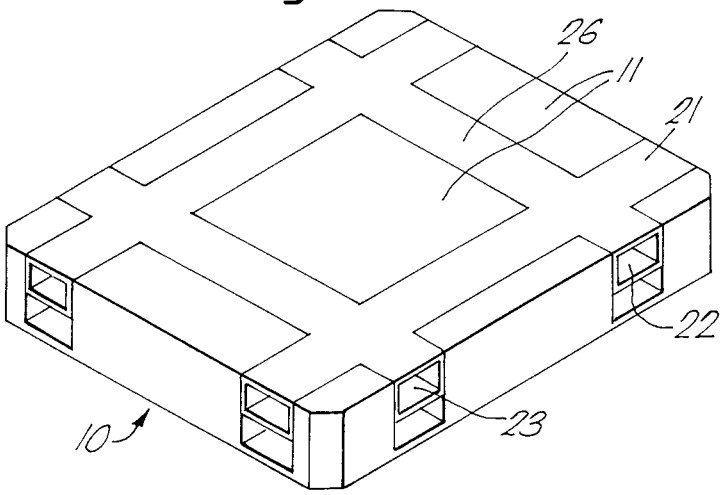
FIG. 2 shows the pallet of FIG. 1, with part thereof in an alternative position.
Figure 2A:
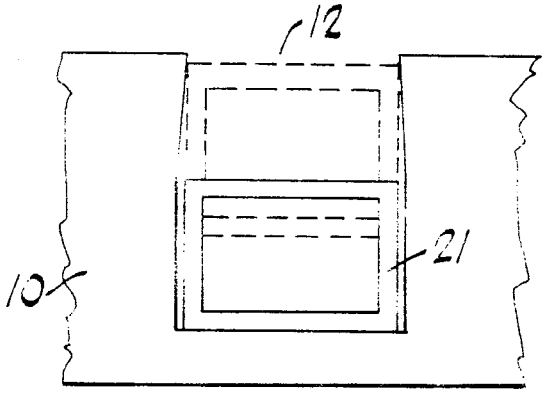
FIGS. 2A and 2B are diagrammatic side views of different embodiments of means for restraining a moveable member in the pallet.
Figure 2B:
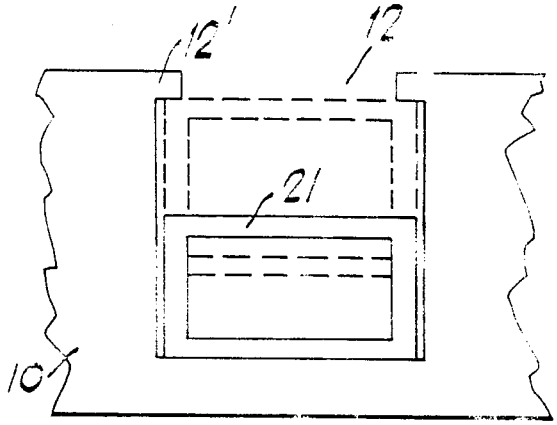
Figure 3:
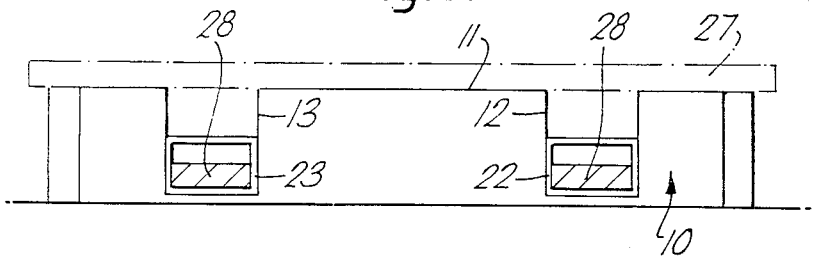
FIG. 3 shows a side view of the pallet being used in a first manner.
Figure 4:
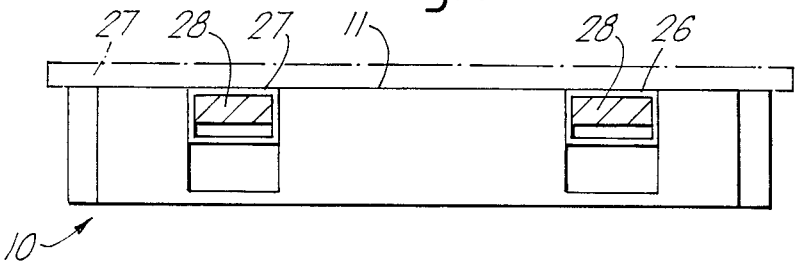
FIG. 4 shows a pallet and load being lifted in this first manner.

FIG. 1 shows a top perspective view of a pallet 10 including a top surface 11 on which a load may be mounted directly or via a deck 27 (FIG. 4). The pallet includes four channels 12,13,14,15 extending downwardly from the top surface 11 and extending, in pairs (12,13, and 14,15) from one side to the opposite side of the pallet 10. The four sides of the pallet 10 are numbered 16,17,18,19. Thus for example, two channels 12,13 extend from the front side 16 to the rear side 18. The two channels 12,13 are spaced from one another by a standard distance so as to be engageable with the forks 28 (see later Figures) of a forklift truck as is well known.

The channels 12,13,14,15 are at least twice the depth required for insertion of the forks 28 of a forklift truck, and therefore, the pallet 10 is approximately twice the depth of a standard pallet. Mounted within the channels 12,13,14,15 is a moveable member 21 which may be considered as comprising four box sections 22,23,24,25 corresponding to the four channels 12,13,14,15. The box sections 22–25 are closed hollow sections and provide first, closed channels and the internal dimensions thereof are of a width and height sufficient that the fork 28 of a forklift truck may be inserted therein. The cross section of each box section 22–25 is rectangular, of a width slightly less than the width of the channels 12–15 which form second open topped channels and of a height approximately half thereof. In this way, the moveable member 21 may move up and down within the channels 12–15.

The moveable member 21 must be restrained so as to be only moveable up so its top surface 26 is generally coplanar with or slightly above the top surface 11 of the pallet. Various means may be provided to restrain this upward movement including, not shown, spigots mounted to the side of the moveable member 21 sliding in slots in the side walls of the channels 12-15, or, making the channels 12-15 of a tapering inward cross section towards their top end (FIG. 24) so that the moveable member engages with the narrow section of the top end of each channel, or, providing an inwardly disposed lip 12 at the top edge of each channel 12-15 which may engage with the moveable member 21.

The pallet 10 may be manufactured of any suitable material including plastic, fibreglass or steel.

The pallet 10 is used in the following manner as described with reference to FIGS. 3-6. Normally the pallet will be used with a flat deck 27 which may be in the form of a sheet of wood, generally comprising a plurality of strips of wood held together by means of a cross brace. The deck 27 is mounted on the top surface 11 of the pallet 10 and as is conventional a load (not shown) is mounted on the deck 27. In the arrangement shown in FIG. 3, if it is desired to lift the pallet 10 with the load, then the forks 28 of a forklift truck are inserted into the first channels comprising the relevant box sections 22,23 of the moveable member 21. Lifting of the forks 28 initially lifts the moveable member 21 up within the channels 12-15 until further upward movement of the moveable member 21 with respect to the channels is restrained, at which time the top surface 26 of the moveable member 21 engages under the deck 27. Further upward movement of the forks 28 lifts the load on the deck 27 together with the pallet 10 as shown in FIG. 4.

Figure 5:
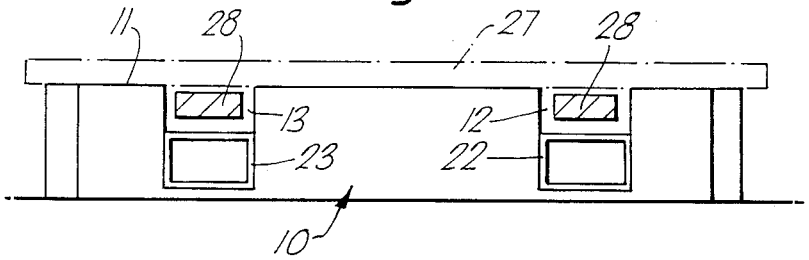
FIG. 5 shows a side view of the pallet being used in a second manner.

If it is desired to lift the load without lifting the pallet, then the forks 28 are inserted into the second channels, that is, the channels 12,13 above the moveable member 21 as illustrated in FIG. 5.

Figure 6:
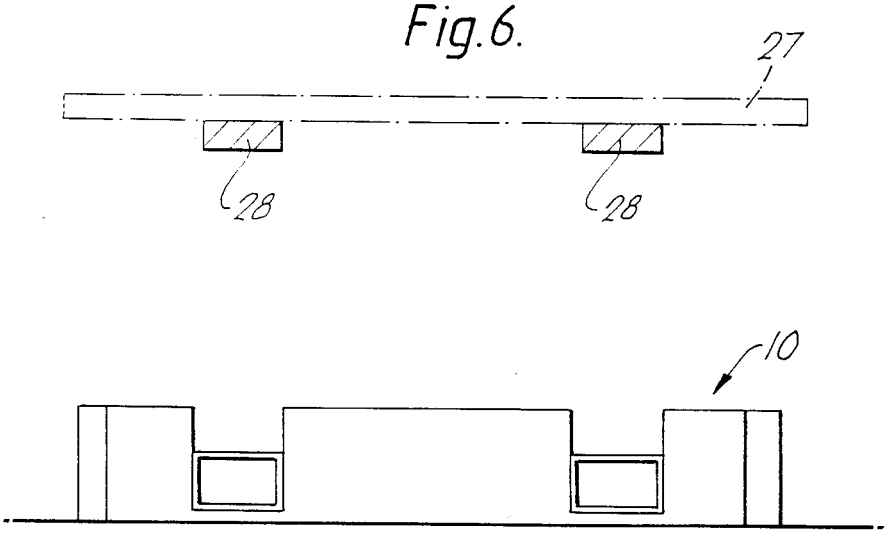
FIG. 6 shows the load alone being lifted in this second manner.

In this position the forks 28 are immediately below the deck 27 and lifting the forks lifts the deck 27 with the load, but leaves the pallet 10 behind as shown in FIG. 6.

Figure 7:
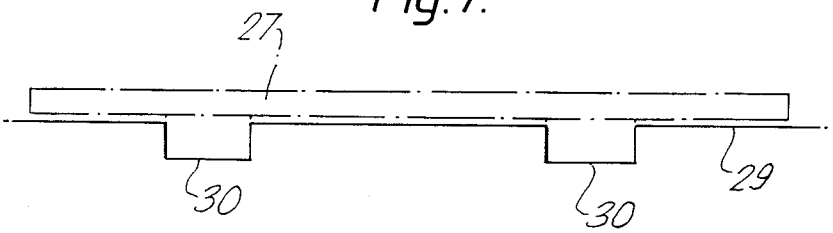
FIG. 7 shows the load mounted on the floor of a truck.
Figure 8:
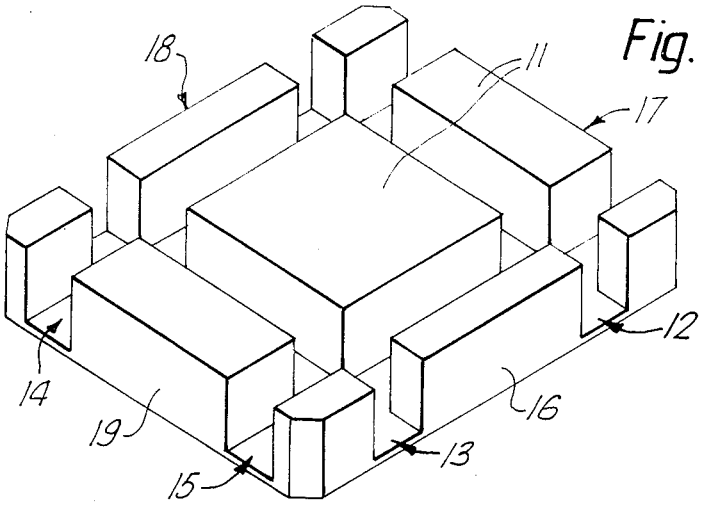
FIG. 8 shows a top perspective view of a first part of the pallet of FIG. 1.
Figure 9:
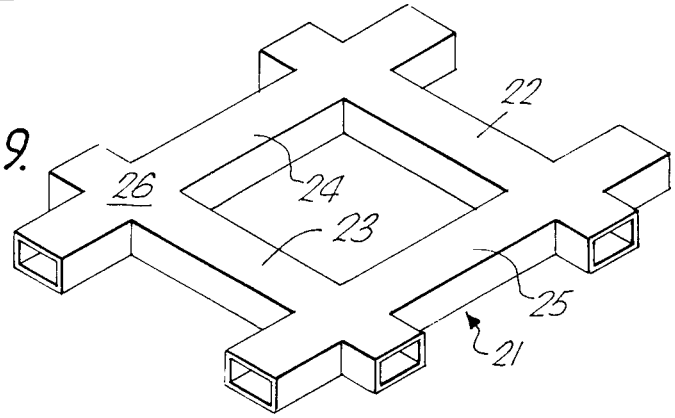
FIG. 9 shows a top perspective view of another part of the pallet of FIG. 1.

The load is normally transferred from a manufacturer on board a truck and thus it will be necessary to modify trucks used with the invention in that in place of a flat floor, there must be provided a grooved floor 29 as shown in FIG. 7. The grooves 30 in the floor 29 of the truck allow the deck 27 to sit in the truck on the floor 29 without the intervention of pallets.

At the delivery end, will be provided pallets 10 and the load may be lifted from the truck with the deck 27 and loaded onto a pallet 10 in an operation opposite to that shown in FIGS. 5 and 6.

In this way, there is not a continuous movement of pallets from the manufacturer to the retailer or wholesaler which reduces considerably the financial outlay of the manufacturer. The only part (apart from the load) to be passed from the manufacturer to the retailer or wholesaler is the deck 27 and in view of its flat nature this can be readily stored and returned to the manufacturer or, in view of its minimal cost, can be disposed of otherwise. In the case of a relatively rigid load, the deck 27 need not be used but the load can sit directly on the top surface 11 of the pallet.

Figure 10:
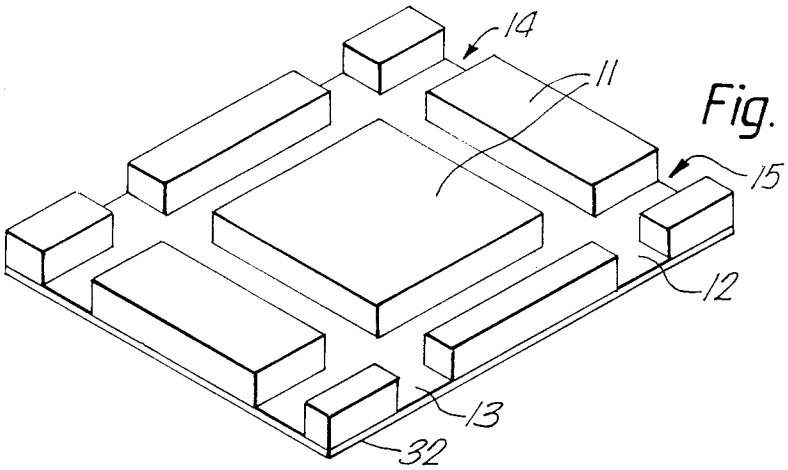
FIG. 10 shows an adaptor for attachment to a conventional pallet whereby to convert it to a pallet according to a second aspect of the invention.
Figure 11:
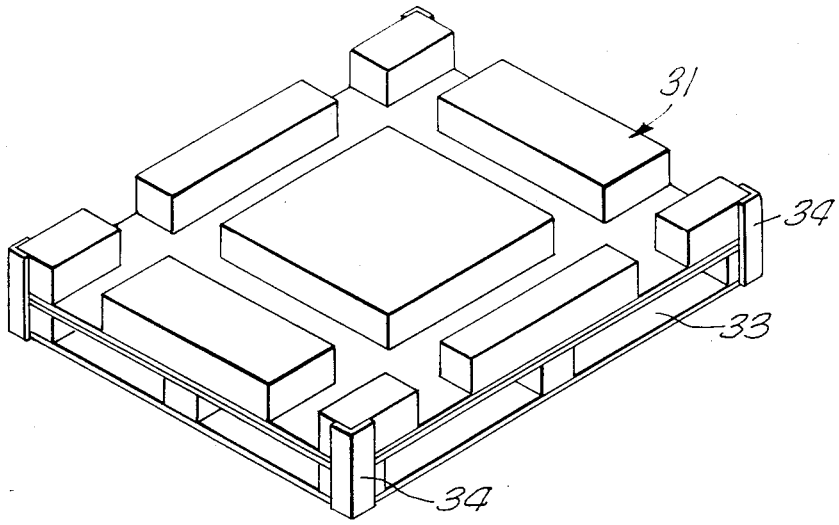
FIG. 11 shows a conventional pallet with the adaptor of FIG. 10 attached, thereby forming a pallet according to a second aspect of the invention, and, FIG. 12 shows a pallet according to a third aspect of the invention.

Alternative arrangements of the invention are shown in FIGS. 10 and 11. FIG. 10 shows an adaptor 31, the base 32 of which may be nailed or otherwise affixed (eg by corner brackets 34) to the top wall of a conventional wooden pallet 33 as shown in FIG. 11 the top wall extending across the whole lateral extent of the pallet. In this case, there is provided an open top set of channels 12-15 (forming the second channels), but in addition, the forks of the forklift truck may also engage in the open sides of the wooden pallet part (which form the first channels) in a conventional way to lift the pallet with the load. In this way, no moving parts are required.

Figure 12:
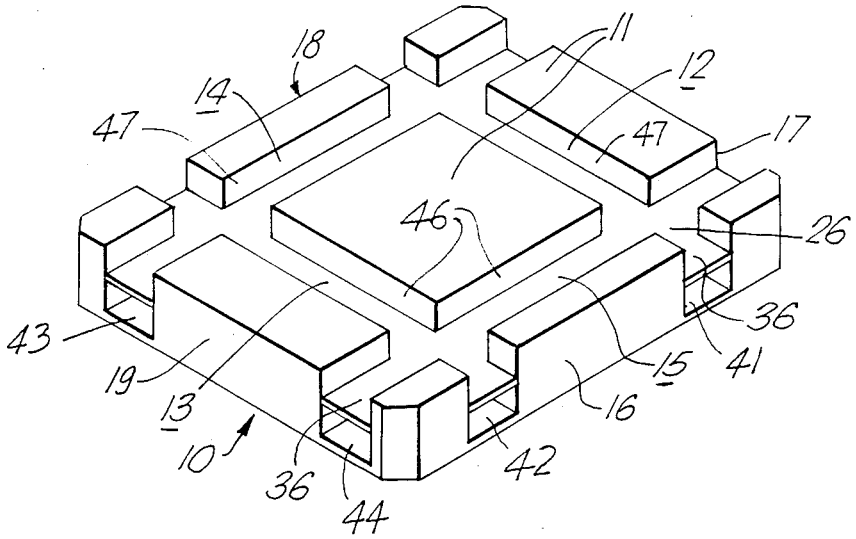

A third embodiment of the invention is shown in FIG. 12. In this case, in place of the moveable member 21, across each channel, there is provided a plate 36 of the same width as the moveable member 21 (and in a position corresponding to the top surface 26 of the moveable member 21 in FIG. 1), the edges of which are firmly affixed to the upright walls 46,47 of the channels (by welding if made of steel) in the position shown to form an upper wall which thereby defines closed section channels 41,42,43,44 corresponding to channels 22-25 of the earlier embodiment.

In this case, to lift the load without the pallet 10, the forks 28 of the fork lift truck are inserted, as before, above this plate 36 in the channels (12-15).

To lift the pallet 10 with the load the forks 28 of the forklift truck are inserted below this plate 36 in closed section channels 41-44. It will be necessary, of course, for the plate 28 to be attached to the side of the channels 12-15 in sufficiently strong manner as to transmit the load from the forks 28 of the forklift truck to the load on the pallet 10.

The invention is not restricted to the details of the foregoing examples. Thus in an alternative arrangement, not illustrated, the pallets may be arranged to be mobile by providing, on their undersurfaces, wheels, rollers or casters.

What is claimed is:

1. A pallet having a top surface (11) on which a load or deck may be mounted, first channels (22-25; 41-44) into which the forks of a forklift truck may be inserted to lift the pallet (10), and second open topped channels (12-15; 46-49) into which the forks of a forklift truck may be inserted to lift the load or deck surface alone without the pallet (10), said first channels (12-25; 41-44) being in the form of closed sections forming part of the pallet itself, said first channels (22-25) being formed by at least one moveable member (21) engaged in the second open topped channels (12-15) whereby at rest the moveable member is situated in the bottom of the open topped channels (12-15) and when engaged by the forks of a forklift truck and raised, moves up, but remains within, the open topped channels (12-15).

2. A pallet as claimed in claim 1 wherein characterised in that the moveable member (21) has a top surface (26) which, when moved up in the open topped channels (12-15), is generally coplanar with the top surface (11) of the pallet (10).

3. A pallet as claimed in claim 2 wherein the moveable member (21) is restrained from leaving the open topped channels (12-15) because of their relative cross sectional shapes.

4. A pallet as claimed in claim 2 comprising means for restraining the moveable member (21) from leaving the open topped channels (12-15).

5. A pallet as claimed in any of claims 1 to 4 wherein two sets of channels are provided on each side to engage the two forks of a forklift truck.

6. A pallet comprising a pallet plate, means secured to said pallet plate thereabove to define four lateral sides with pairs of openings at right angles to one another into which the forks of a forklift truck are engageable and two pairs of spaced channels extending at right angles to one another and having open tops, said means defining a top surface on which a load can be mounted, said channels extending downwardly from said top surface so that the forks of a forklift truck are selectively engageable in said channels or in said openings at the lateral sides at right angle positions, said means comprising a bottom plate extending parallel to said pallet plate in spaced relation thereabove and extending across substantially the entire lateral extend of the pallet plate.

7. A pallet comprising a pallet plate, means secured to said pallet plate thereabove to define four lateral sides with pairs of openings at right angles to one another into which the forks of a forklift truck are engageable and two pairs of spaced channels extending at right angles to one another and having open tops, said means defining a top surface on which a load can be mounted, said channels extending downwardly from said top surface so that the forks of a forklift truck are selectively engageable in said channels or in said openings at the lateral sides at right angle positions, said pallet plate comprising an adaptor structure therein including upright wall members defining said two pairs of spaced channels at right angles to one another, said means comprising a bottom plate fitted in said channels and fixed to said wall members to form tops for said openings at the four lateral sides and bottoms of the open top channels.

8. A pallet comprising a pallet plate, means secured to said pallet plate thereabove to define four lateral sides with pairs of openings at right angles to one another into which the forks of a forklift truck are engageable and two pairs of spaced channels extending at right angles to one another and having open tops, said means defining a top surface on which a load can be mounted, said channels extending downwardly from said top surface so that the forks of a forklift truck are selectively engageable in said channels or in said openings at the lateral sides at right angle positions, said means comprising an adaptor including a bottom plate extending parallel to said pallet plate in spaced relation thereabove, said spaced channels and said top surface being formed on said adaptor.

* * * * *